United States Patent [19]

Culbreth

[11] Patent Number: 4,921,105

[45] Date of Patent: May 1, 1990

[54] SHIPPING, STORAGE AND DISPENSING CONTAINER FOR FLEXIBLE DUCT AND THE LIKE

[75] Inventor: Keith C. Culbreth, Anderson, S.C.

[73] Assignee: Automation Industries, Inc., Greenwood, S.C.

[21] Appl. No.: 325,991

[22] Filed: Mar. 20, 1989

[51] Int. Cl.[5] ..... B65D 75/58; B65D 77/30

[52] U.S. Cl. ..... 206/626; 206/621; 206/303; 206/634; 229/117.16

[58] Field of Search ..... 206/626, 628, 624, 634, 206/303, 621, 612; 229/52 B

[56] References Cited

U.S. PATENT DOCUMENTS

| | | | |
|---|---|---|---|
| 2,115,673 | 4/1938 | Stompe | 206/628 |
| 3,286,830 | 11/1966 | Robb, Jr. | 206/628 |
| 3,315,875 | 4/1967 | Practorius | 206/628 |
| 3,367,559 | 2/1968 | Waldrop | 206/626 |
| 3,580,482 | 5/1971 | Witte | 206/626 |
| 4,043,503 | 8/1977 | Meyers et al. | 206/612 |
| 4,405,044 | 9/1983 | Flower et al. | 206/626 |
| 4,771,884 | 9/1988 | Lamborn et al. | 206/621 |

*Primary Examiner*—David T. Fidei

*Attorney, Agent, or Firm*—Francis N. Carten

[57] ABSTRACT

A shipping, storing and dispensing container for a length of longitudinally- and radially-compressible product such as insulated or uninsulated duct for air conditioning systems. The container is adapted to have a lateral dispensing opening formed therein for allowing a desired length of compressed flexible duct or other similar product contained therein to be controllably drawn from the container, and to prevent such product from springing out of the container as a result of its internal compressive forces. The lateral dispensing opening is formed in one side and near one end of the container by punching out a flap defined by partially die-cut lines along one side and near one end of the container. The flap may be frictionally engaged with the edges of the container forming the lateral dispensing opening to close the lateral dispensing opening and re-seal the container.

10 Claims, 2 Drawing Sheets

SHIPPING, STORAGE AND DISPENSING CONTAINER FOR FLEXIBLE DUCT AND THE LIKE

SUMMARY OF THE INVENTION

The present invention is embodied in a container adapted to have a lateral dispensing opening formed therein for allowing a desired length of compressed flexible duct or other similar product contained therein to be controllably drawn from the container, and to prevent such product from springing out of the container as a result of its internal compressive forces. The lateral dispensing opening is formed in one side and near one end of the container so as to require the contained product to be turned in a direction parallel to the inner surface of said one end of the container and thereby frictionally engage said inner surface to cause braking forces to be developed between the contained product and said inner surface. The lateral dispensing opening is formed by punching out a flap defined by die-cut score lines along one side and near one end of the container. The lateral dispensing opening is preferably smaller in one dimension than the diameter of contained product to provide further controlling forces for restraining the contained product. Because of the lateral position of the dispensing opening, the container may be held against any available surface with one hand pressing on the side of the container in which the dispensing opening is formed, while the desired amount of duct is pulled from the container with the other hand, thereby eliminating the need for restraining means as seen in certain prior art. The flap may be frictionally engaged with the edges of the container forming the lateral dispensing opening to close the lateral dispensing opening and re-seal the container after the end of the undispensed product has been forced into abutment with the inner surface of said one end of the container.

DESCRIPTION OF THE DRAWINGS

The written description of the present invention will be more fully understood when read with reference to the accompanying drawings, of which.

DETAILED DESCRIPTION OF THE PREFERRED EMBODIMENT

Figure 1:
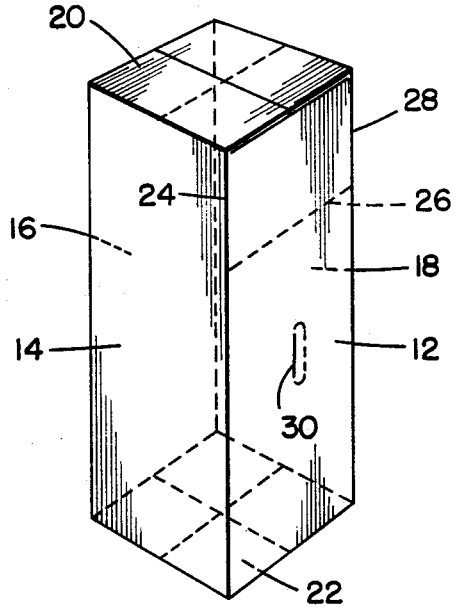
FIG. 1 is a first perspective view of the preferred embodiment of applicant's shipping, storing and dispensing container, shown without a length of insulated flexible duct therein so as to more clearly illustrate the features of the container per se.
Figure 2:
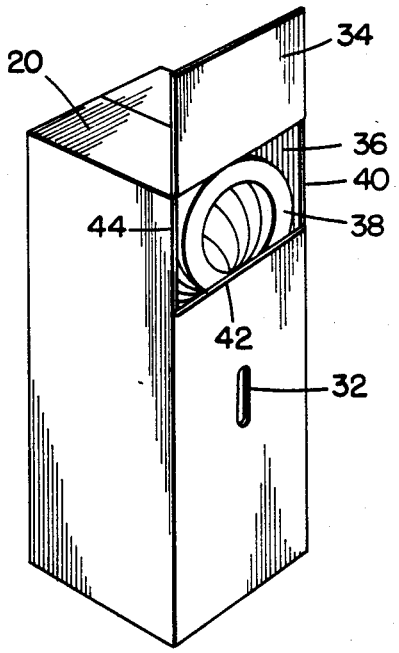
FIG. 2 is a second perspective view of the preferred embodiment of applicant's shipping, storing and dispensing container with a length of insulated flexible duct contained therein.
Figure 5:
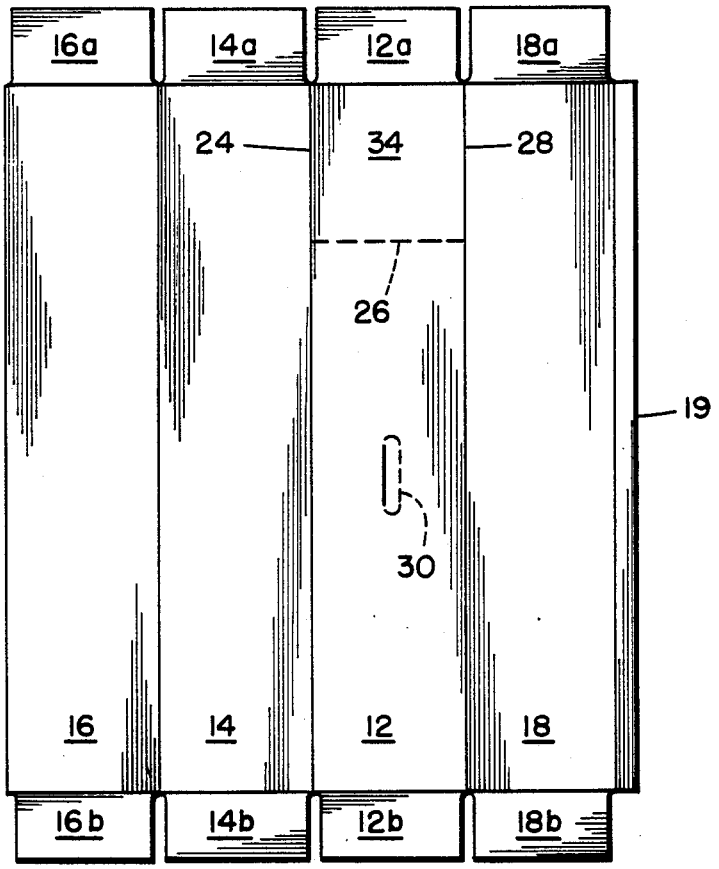
FIG. 5 is a plan view of the blank from which applicant's container is formed.

Referring now specifically to FIGS. 1, 2 and 5, the container 10 is formed of four side walls 12, 14, 16 and 18 of substantially equal length and width, and two square end walls 20 and 22 formed by folding end flaps which are extensions of the four side walls 12, 14, 16 and 18 and glueing, taping or stapling the end flaps together, all in conventional manner as shown in prior art such as U.S. Pat. No. 2,946,496 (Stagmeier), for example. Various modifications of such containers have been made to provide a dispensing opening therein for a wide variety of products. In U.S. Pat. No. 2,946,496 (Stagmeier), the product to be dispensed is comminuted foodstuffs, e.g., dry breakfast cereal. In U.S. Pat. No. 3,768,642 (Hansen et al.), the product to be dispensed is stacked, compressed frameless air filter elements. In U.S. Pat. No. 4,771,884 (Lamborn et al.), the product to be dispensed is flexible duct. Although other examples of such modifications could be given, none are believed to be more relevant to the present invention than the foregoing, Another item of prior art of possible interest is U.S. Pat. No. 3,924,661 (Bornhoffer), which addresses the matter of storage and dispensing of reusable compressible flexible hose in the somewhat different context of waste drains for recreational vehicles.

The present applicant has devised a relatively simple, inexpensive, and readily implemented modification of a known form of container for flexible duct which, in a novel manner, overcomes a problem encountered when opening one end of a container in which compressed duct is stored. As a result of its internal compressive forces acting against the closed end of the container, the duct will spring out of the opened end of the known form of container; this is sometimes referred to as the "jack-in-the-box" phenomenon. Applicant has solved this problem by placing the dispensing opening in one side and adjacent one end of the container so as to require the contained duct to be turned in a direction parallel to the inner surface of the adjacent end of the container. In this manner, the outer surface of the duct 38 frictionally engages the inner surface of the adjacent end of the container to cause braking forces to be generated between the duct and that inner surface. Applicant's preferred method of providing this lateral dispensing opening is by forming a series of three score lines 24, 26, 28 in a U-configuration just below one end 20 of container 10, as shown in FIG. 1. The vertical score lines 24 and 28 coincide with the fold lines that separate sides 12 and 14 and sides 12 and 18, respectively. The three score lines 24, 26, 28 are preferably formed by die-cutting, with the cuts being of sufficient width and spacing to enable the dispensing flap 34 shown in FIGS. 2, 3 and 4 to be punched out by hand without the need for any tools, and at the same time leaving that part of the container strong enough so that it provides effective protection for the duct during shipping and storage and maintains its structural integrity during the loading of duct into the container 10. A hand grip 32 may be also formed by die-cutting a handlebar-shaped line 30 as shown in FIG. 1, which may be punched in and folded back as shown in FIG. 2.

To provide additional control over the duct as it is drawn through the lateral dispensing opening 36, the vertical dimension of that opening is preferably less than the outer diameter of the duct in order to exert radially-compressive forces on the duct as it exits the container 10. In the case of insulated duct, it has been found possible and even desirable to reduce the vertical dimension of the lateral dispensing opening 36 to slightly less than the inner diameter of the duct in order to form a mechanical lock with the spiral wire which acts as an inner support member for the duct. Examples of such insulated duct are shown in U.S. Pat. No. 3,885,593 (Koerber et al.) and No. 4,427,485 (Kutnyak et al.).

Figure 3:
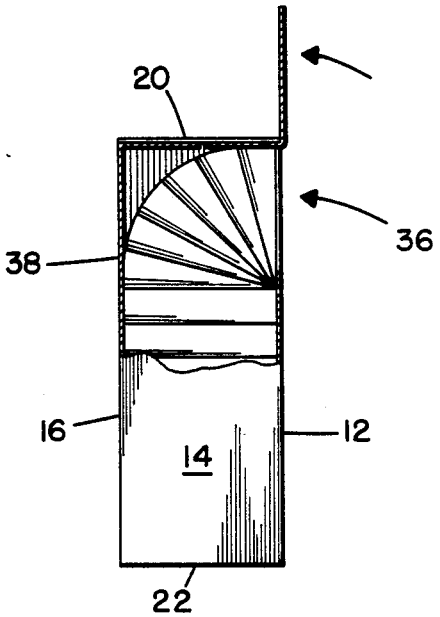
FIG. 3 is a partially broken-away side elevation of the container shown in FIG. 2, showing a length of insulated flexible duct oriented for withdrawal through a lateral dispensing opening.
Figure 4:
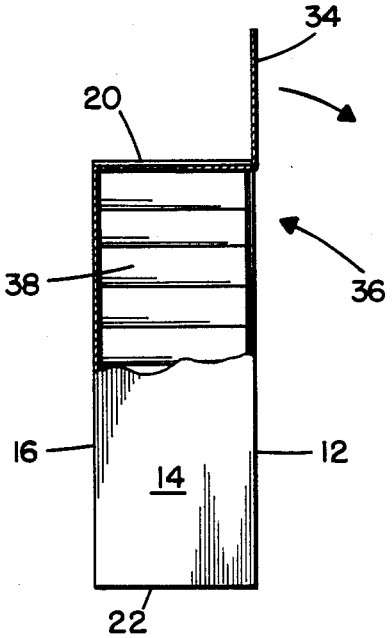
FIG. 4 is a partially broken-away side elevation of the container shown in FIG. 2, showing a length of insulated flexible duct oriented for storage therein.

FIG. 3 shows the relationship of the duct 38 with the lateral dispensing opening 36 and the inner surface of wall 20 when positioned to be drawn out of the container 10. After dispensing the desired number of lengths of compressed duct 38 from this novel container 10, the end of the remaining duct appearing at the lateral dispensing opening 36 can be re-oriented to abut the inner surface of the adjacent end of the container as shown in FIG. 4, and the lateral dispensing opening 36 can be closed by swinging the flap 34 into its original position to be frictionally engaged with the edges 40, 42, 44 (see FIG. 2) forming the lateral dispensing opening 36 of the container 10, thereby closing the lateral dispensing opening 36. Rather than rely on the interference fit thus effected, tape or other similar means may then be used to secure the flap 34 and re-seal the container 10 for storage and/or shipping.

FIG. 5 shows the blank from which the container 10 is formed. In an intermediate stage of formation, the blank is folded in half along the line between sides 12 and 14, and edge flap 19 is folded and glued to the opposing inner surface of side 16. In this unfinished form, the container 10 can be stored flat in large quantities and take up the absolute minimum of storage space.

Certain modifications and variations of the disclosed embodiment of the present invention will be apparent to those skilled in the art. It should be understood that the disclosed embodiment is intended to be illustrative only, and not in any way restrictive of the scope of the invention as defined by the claims set forth hereunder.

I claim:

1. A container (10) for shipping, storing and dispensing a longitudinally- and radially-compressible product (38), comprising:

(a) four side walls (12, 14, 16 and 18) of substantially equal length and width with respect to one another;

(b) folding end flaps (12*a*, 14*a*, 16*a*, 18*a* and 12*b*, 14*b*, 16*b*, 18*b*) extending from said four side walls (12, 14, 16 and 18) for forming two square end walls (20, 22); and (c) a series of three score lines (24, 26, 28) in a U-configuration below one folding end flap (12*a*) of container (10) to enable formation in one side (12) of a lateral dispensing opening (36) which is smaller in one dimension than one diameter of the longitudinally- and radially-compressible product 938) to be contained and is reclosable by means of a dispensing flap (34) formed by hinging a section of said one side 912) defined by said three score lines (24, 26, 28) away from said one side (12).

2. The container (10) according to claim 1, wherein said series of score lines (24, 26, 28) comprises:

(a) first and second vertical score lines (24, 28); and (b) a horizontal score line (26) joining the lower ends of said first and second vertical score lines (24, 28).

3. The container (10) according to claim 1, wherein said lateral dispensing opening (36) is smaller in one dimension than the outer diameter of the longitudinally- and radially-compressible product (38) to be contained.

4. The container (10) according to claim 1, wherein said lateral dispensing opening (36) is smaller in one dimension than the inner diameter of the longitudinally- and radially-compressible product (38) to be contained.

5. The container (10) according to claim 2, further comprising a handlebar-shaped score line (30) formed in said one side (12) below said horizontal score line (26) to enable formation of a hand hold.

6. The combination of a shipping, storing and dispensing container (10) and a length of longitudinally- and radially-compressible product (38), in which:

(a) said length of longitudinally- and radially-compressible product is compressed longitudinally within said container (10); and (b) said container (10) comprises:

(i) four side walls 912, 14, 16 and 18) of substantially equal length and width with respect to one another;

(ii) two square end walls (20, 22) formed by folding end flaps (12*a*, 14*a*, 16*a*, 18*a* and 12*b*, 14*b*, 16*b*, 18*b*) which are extensions of the four side walls (12, 14, 16 and 18); and (iii) a series of three score lines (24, 26, 28) in a U-configuration below one end (20) of container (10) to enable formation in one side (12) of a lateral dispensing opening 936) which is reclosable by means of a dispensing flap (34) formed by hinging a section of said one side (12) defined by said three score lines (24, 26, 28) away from said one side (12).

7. The combination according to claim 6, wherein said series of score lines (24, 26, 28) comprises:

(a) first and second vertical score lines (24, 28); and (b) a horizontal score line (26) joining the lower ends of said first and second vertical score lines (24, 28).

8. The combination according to claim 6, wherein said lateral dispensing opening (36) is smaller in one dimension than the outer diameter of said longitudinally- and radially-compressible product (38).

9. The combination according to claim 6, wherein said lateral dispensing opening (36) is smaller in one dimension than the inner diameter of said longitudinally- and radially-compressible product (38).

10. The combination according to claim 6, further comprising a handlebar-shaped score line (30) formed in said one side (12) below said horizontal score line (26) to enable formation of a hand hold.

* * * * *

UNITED STATES PATENT AND TRADEMARK OFFICE

CERTIFICATE OF CORRECTION

PATENT NO. : 4,921,105

DATED : May 1, 1990

INVENTOR(S) : Keith C. Culbreth

It is certified that error appears in the above-identified patent and that said Letters Patent is hereby corrected as shown below:

Column 3, line 53, (claim 1, line 12) change "938)" to --(38)--;
line 56, (claim 1, line 15) change "912)" to --(12)--.

Column 4, line 25, (claim 6, line 8) change "912," to --(12,--;
line 35, (claim 6, line 18) change "936)" to --(36)--.

Signed and Sealed this

Fifth Day of November, 1991

*Attest:*

HARRY F. MANBECK, JR.

*Attesting Officer*

*Commissioner of Patents and Trademarks*